United States Patent [19]

Hormann

[11] Patent Number: 4,878,529

[45] Date of Patent: Nov. 7, 1989

[54] SECTIONAL OVERHEAD DOOR FOR LOW LINTEL HEIGHTS

[75] Inventor: Michael Hormann, Steinhagen, Fed. Rep. of Germany

[73] Assignee: Hormann KG Brockhagen, Steinhagen, Fed. Rep. of Germany

[21] Appl. No.: 7,651

[22] Filed: Jan. 28, 1987

[30] Foreign Application Priority Data

Jan. 28, 1986 [DE] Fed. Rep. of Germany ..... 3602520

[51] Int. Cl.[4] ..... E05D 15/16

[52] U.S. Cl. ..... 160/201; 160/191

[58] Field of Search ..... 160/201, 189, 190, 191, 160/192, 193, 188

[56] References Cited

U.S. PATENT DOCUMENTS

| | | | |
|---|---|---|---|
| 1,897,391 | 2/1933 | Kelly | 160/191 |
| 2,015,402 | 9/1935 | Johanson | 160/189 |
| 2,271,309 | 1/1942 | Rowe | 160/201 X |
| 2,732,201 | 1/1956 | Franko | 160/188 |
| 2,790,635 | 4/1957 | Evans et al. | 160/188 |
| 2,794,634 | 6/1957 | Bragg | 160/188 X |
| 3,038,535 | 6/1962 | Stroup et al. | 160/191 |
| 3,289,350 | 12/1966 | Moody | 160/188 X |
| 4,119,133 | 10/1978 | Wolf | 160/201 X |

*Primary Examiner*—Ramon S. Britts
*Assistant Examiner*—David M. Purol
*Attorney, Agent, or Firm*—Antonelli, Terry & Wands

[57] ABSTRACT

Sectional overhead garage door for low lintel heights, with the door leaf members of which, except for the one that is uppermost in the closed position, being guided in guide rails having a vertical, an arcuate, and a horizontal section, and with rollers of the uppermost door leaf member being guided in two guide rails, extending with an approximately horizontal section above and in parallel to the approximately horizontal primary guide section provided on the same side, and each of these being connected to an intermediate guide member adapted to be lowered from the horizontal in the direction of the upper frame zone, so that the uppermost door leaf member, when the door leaf is transferred into the closed position, passes into the plane of the closed door leaf along a shorter path than the remaining door leaf members. The arrangement of the intermediate guide member for the rollers of the uppermost door leaf member is such that a weight balancing shaft, torsion springs, and the rollers can be attached at a lower level. This is achieved by providing the intermediate guide member for the rollers of the uppermost door leaf member as well as the torsion shaft bearing at special bearing brackets in the two upper corner zones of the door frame, and fashioning the intermediate guide members with a linear zone between end sections that are of a curved and, respectively, angled configuration.

11 Claims, 3 Drawing Sheets

SECTIONAL OVERHEAD DOOR FOR LOW LINTEL HEIGHTS

BACKGROUND OF THE INVENTION

The invention relates to a sectional overhead door arrangement and, particularly, to an intermediate guide member of guide means for the rollers arranged in upper corner zones of the door leaf member that is uppermost in the closed position.

In sectional overhead doors of the aforementioned type, the rollers provided in the upper corner zones of the door leaf member that is uppermost in the closed position are held in separate guide means, guided separately from the usual guide for the rollers of the door leaf members adjoining in the downward direction, are available in the state of the art in various designs. The intermediate guide members between the horizontal guide section for these rollers of the uppermost door leaf member and the frame are of an arcuate configuration, namely, in an arc having a larger radius than the arc of the bridging sections for the guidance of the rollers of the remaining door leaf members. These bridging sections, in their curved form, are not only difficult to produce but also interfere, due to their convex shape with respect to the ceiling of the room to be closed, with a space-saving arrangement, regarding the lintel height of the door aperture, for the weight balancing mechanism for the door leaf in the form of a shaft with torsion springs mounted thereon and with rope drums provided at both ends.

Moreover, in the conventional section overhead doors of this type of structure, assembly is cumersome because the mounting of the guide rails and of the weight balancing mechanism is executed by disposing individual parts, in part in a difficult spatial correlation and combination.

The present invention resides in providing a door of the aforementioned type which employs components that can be manufactured in a simple, compact and precise fashion and can be installed even in case of a low installation height between the upper terminal rim of the door aperture to be closed and the ceiling of the room to be enclosed by the door, and which can be mounted, with extensively preassembled parts, in an especially simple way at the site.

This has been accomplished according to the invention, by mounting the intermediate guide member for the rollers of the door leaf member that is uppermost in the closed position, as well as the torsion shaft bearing, at special bearing brackets attached in the two upper corner zones of the door frame, and by forming the intermediate guide members with a linear zone between end sections that are respectively curved and bent at an angle.

The above and other objects, features, and advantages of the present invention would become more apparent from the following description when taken in connection with the accompanying drawings which show, for the purpose of illustration only, embodiments of the present invention.

DETAILED DESCRIPTION

Figure 1:
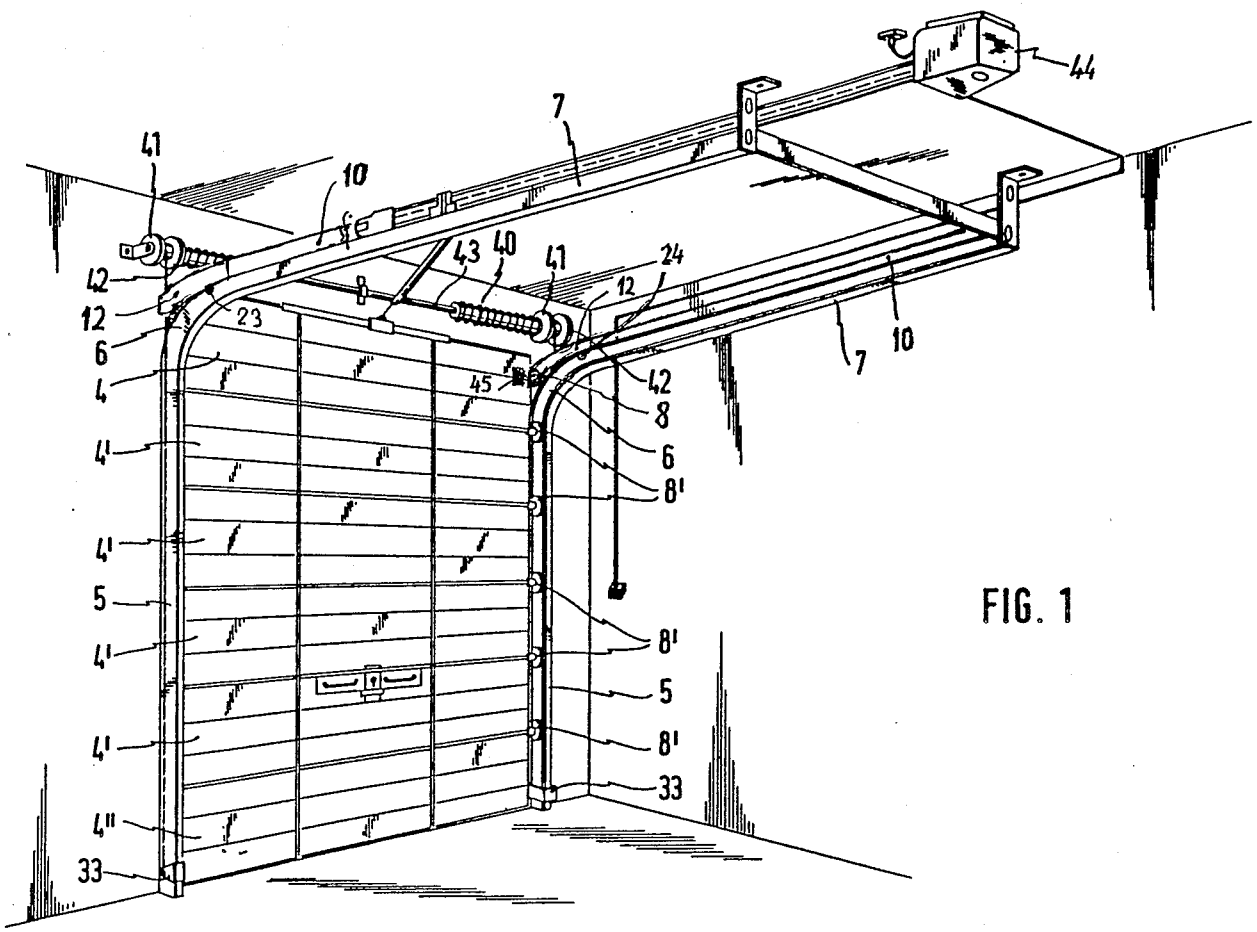
FIG. 1 is a perspective view of an interior of a sectional overhead garage door constructed in accordance with the present invention.

Referring now to the drawings wherein like reference numerals are used throughout the various views to designate like parts and, more particularly, to FIG. 1, according to this FIG., an overhead sectional door in a closed condition or position, includes a number of panels or slates successively articulated to one another, with the uppermost panel 4 being held at a top rim thereof in lateral secondary guide rails by rollers 8, and with each of the lateral secondary guide rails including a horizontally and linearly extending section 10 and a section on the frame side constructed as an intermediate guide member 12. The remaining panels 4', 4'' are held by way of rollers 8' adjustable with respect to their spacing in the primary guide rails extending on both sides of the door leaf. The primary guide rails respectively include an approximately vertical section 5, an adjoining arcuate transitional guide section 6, and a horizontal section 7, with the horizontal section 7 extending approximately in parallel to a ceiling or upper member of the garage or room to be closed. A torsion spring mechanism 40, is provided for weight balancing, extends above the intermediate guide member12 of the secondary guide rails beyond the door aperture to be closed and includes on both sides, respectively outside of the door leaf, drums 41, onto which and from which hoisting ropes 42 can respectively be wound and unwound. Depending on the space available, the hoisting rope 42 runs onto the drums either on the side facing the door opening or on the side facing the interior of the garage a room to be close. In the latter case, the ends of the hoisting rope 42 are mounted via fishplates to the lowermost door panel 4'', with the fishplates extending over the respective associated guide rail. This arrangement makes it possible to arrange the torsion spring mechanism 40 with the drums especially closely, and thus in a space-saving fashion, to the wall having the door opening.

Figure 2:
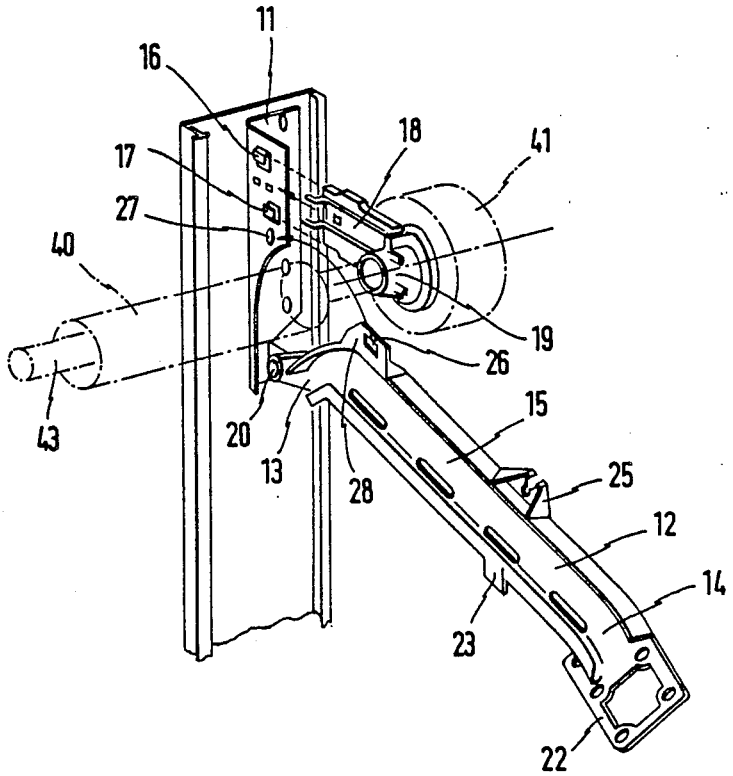
FIG. 2 is a perspective view of one upper corner zone of the door frame with a bearing bracket to which are mounted one of the bearings of a weight balancing shaft as well the end zone, on a frame side, of an intermediate guide member for rollers of a door leaf member that is uppermost in a closed position of the door.

FIG. 2 illustrates one corner zone of a lateral frame with a bearing bracket 11 which is repeated in mirror-image symmetry arrangement in the other corner frame zone. The frame F is disposed on respective sides of the opening accommodating the overhead door arrangement and includes vertically extending spaced rims R. The bracket 11 is formed as an angle member, with one leg extending in parallel to the plane of the frame and affixed to the frame F, and the other leg L2 projecting approximately vertically inwards away from the frame F and carrying mounting means for the weight balancing shaft 43 and the intermediate guide member 12 for the rollers of the door leaf member 4. The end of the intermediate guide member 12 on the frame side is provided with a bore 20, located at the bottom with respect to the vertical extension of the frame F, with threaded bolt, not shown, passing through the bore 20 and penetrating through a corresponding bore (not visible) in a region of the leg L2 of the bearing bracket 11 in the lower region of the bracket 11. Due to the threaded bolt connection, the intermediate guide member 12 can be pivoted during assembly about the axis of the threaded bolt in the bore 20 in a vertical plane. During the course of assembly, the intermediate guide member 12 is initially held against the bearing bracket 11 merely by way of the pivotal connection at formed the bar 20, so that it can be retained in a downwardly projecting position with respect to the frame plane and facilitate to a special degree the assembly of the remaining guide elements of the primary guide means and the secondary guide means. After the assembly of the guide elements has been completed, the entire guide frame is swung upwards so that a bore 26 of the intermediate guide member 12, provided in the upper end zone on the frame side at a mounting elements 16, 17, registers with a bore 27 in the bearing bracket 11. A threaded bolt is passed through the registering bores 26 and 27, whereby the angular position between the intermediate gude member 12 and the plane of the frame is determined.

The weight balancing shaft is extensively preassembled, optionally subdivided in the longitudinal direction depending on length, in such a manner that the shaft zone adjoining the illustrated corner zone can be affixed, in the preassembled condition, with the torsion shaft mechanism 40 and rope drum 41, to the bearing bracket 11 via the shaft bearing 19. The shaft bearing 19 preferably comprises a conical part projecting in the direction of the torsion spring mechanism 40 for the accommodation of the adjoining spring end and is equipped with a roller bearing for the shaft 43. The shaft bearing 19 is provided with a radially projecting web member 18 which is of a flat contruction and forms gude means in longitudinal rim zones thereof. In order to increase bending resistance, the web member 18 is provided with rib-like projections extending away from its surface. The leg of the bearing bracket 11, preferably formed of sheet metal and projecting away from the plane of the frame, is provided with mounting elements 16 and 17 designed so as to project in a hook shape from the plane of the leg L2. The mounting elements 16, 17 define guide grooves between the inside of their end zone and the adjoining leg surface. The longitudinal rims of the web member 18 of the shaft bearing 19 can be introduced into these guide grooves. In this arrangement, the mounting element 16, located at the top, is fashioned to be closer to the frame than the mounting element 17, located at the bottom, so that the connecting line between the mounting elements 16, 17. After results in a larger spacing than the width of the web member 18 of the shaft bearing 19. Thus, the web member 18 can be conveniently introduced obliquely from above into the groove-like mounting with the mounting elements 16, 17. After such introduction, the shaft or the shaft bearing 19 is lowered so that the web member 18 comes, with favorable torque distribution, into contact by groove-like engagement between the leg of the bearing bracket 11 and the mounting elements 16 and 17 formed therefrom. The web member 18 includes a bore registering with a slotted-hole bore extending in the longitudinal direction of the web member 18, or with several bores, arranged in series in this direction, of the leg L2 of the bearing bracket 11 projecting vertically from the frame plane. After introducing a threaded bolt through the bore of the web member 18 and the slotted-hole bore or, respectively, one of the series-disposed bores in the projecting leg of the bearing bracket 11, the shaft bearing 19 can be fixed, at an adjusted spacing form the plane of the frame, to the bearing bracket 11.

During the course of initial assembly, the intermediate guide member 12 is mounted with articulation first of all only with regard to its bore 20 to the bearing bracket 11 with the aid of a threaded bolt, so that it can be connected, while projecting obliquelyu downwardly, to the remaining guide compondents. Thereafter, the entire guide arrangement and thus the intermediate guide member 12 is swung upwards in a vertical plane so that the bore 26 in the web-like projecting zone of the intermediate guide member 12, made as a pressure-die casting, comes into flush alignment with the bore 27 in the bearing bracket 11. A guide tab 28, oriented toward the frame and laterally bent away from the pivoting direction, facilitates the assumption of the final pivoted position of the intermediate guide member 12 with respect to the bearing bracket 11. After introducing a bolt through the bores 26 and 27, now being brought into alignment, the intermediate guide member 12 is affixed to the bearing bracket 11 at an accurate angle.

Figure 3:
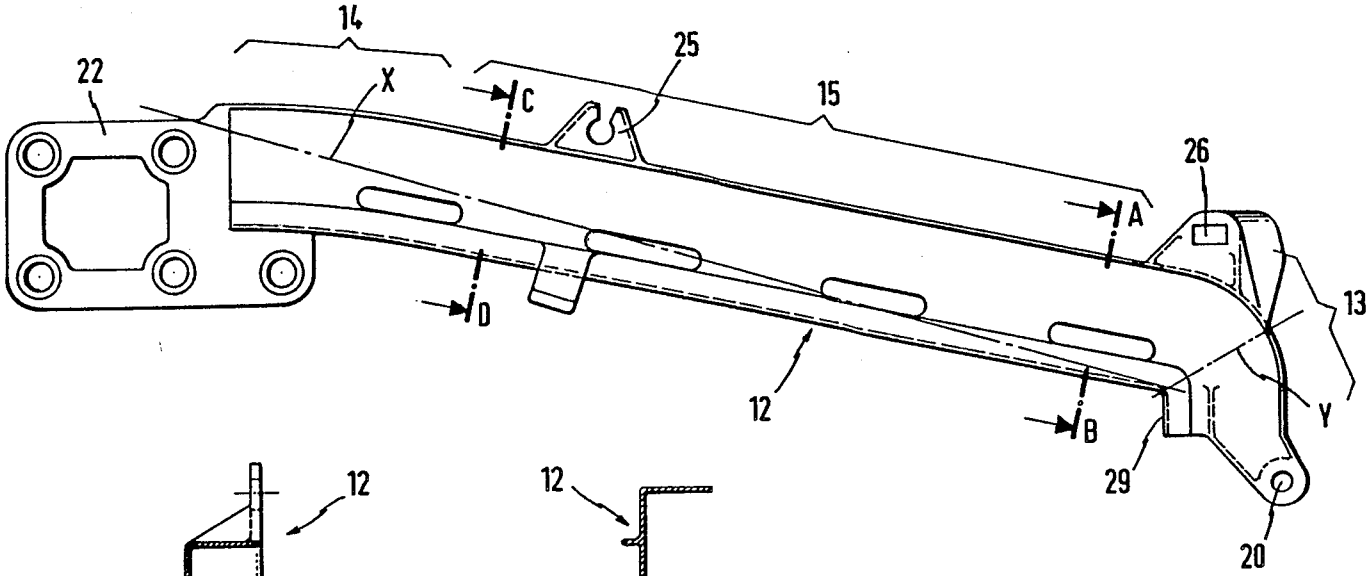
FIG. 3, is a lateral view of the intermediate guide member in FIG. 2.
Figure 5:
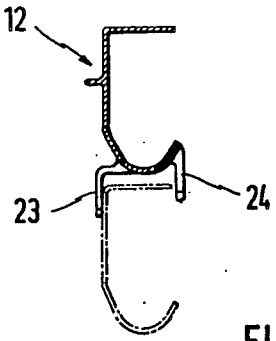
FIG. 5 is a cross-sectional view taken along the line C-D in FIG. 3.
Figure 4:
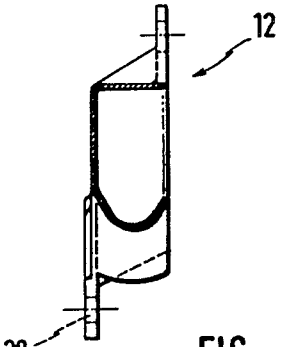
FIG. 4, is a cross-sectional view taken along the line A-B in FIG. 3.

As shown in FIG. 3, the intermediate guide member 12, is formed to be curved and angled at its two end zones. In the zone illustrated on the right, the bore 20, forming a pivotal threaded connnection during assembly to the bearing bracket 11, is arranged in the end zone 13 oriented downwardly in the operating position, with the end zone 13 passing over, under an angle that is a little more than 90°, into the linearly fashioned section 15 of the intermediate guide member 12. At the other end, the intermediate guide member 12 terminates into an approximately horizontally extending guide means, not shown (secondary guide section 10 in FIG. 1), namely, by way of a slightly curved end zone 14. On an outside of the guide space, a connecting plate 22 is formed at the curved end zone 14. The connecting plate 22 carries a series of bores serving for connecting the intermediate guide member 12 with the associated, approximately horizontally extending guide section 10, and to the guide section 7, extending therebelow in parallel therewith, for the rollers of the remaining door leaf members. This series of bores is provided with correspondingly arranged openings for accommodating threaded volts. In the initial zone of the linearly extending section 15 of the intermediate guide member 12, downwardly projecting holding lugs 23 and 24 are formed which receive between them, in a stabilizing fashion, the circuit-arc-shaped transition guide section 6, not shown, between the horizontally extending guide section 7, and the vertically extending guide section 5, pertaining to the rollers of the remaining door leaf members (FIG. 1). An upwardly projecting section 25 with a groove opening designed to be undercut is formed likewise in this initial zone of the linearly extending longitudinal section 15 of the intermediate guide member 12. The free end of an operating string for the manually opening to the door leaf can be introduced into this groove opening.

As seen from the horizontal guide section 10 for the rollers of the door leaf member 4, the linear longitudinal section 15 of the intermediate guide member 12 is only slightly inclined from the horizontal downwardly toward the frame, that is the arcuate end section of the end zone 14 adjoining the horizontal guide section 10 forms a very large obtuse angel with the linear longitudinal section 15.

In the end zone on the frame side, the intermediate guide member 12 is fashioned with a guide end zone 13 oriented linearly downwardly, with this end zone forming an obtuse angle with the longitudinal axis of the linearly extending longitudinal section 15 of the intermediate member 12, this angle being only little larger than 90°. The end zone 13, extending approximately vertically in parallel to the lateral frame, receives the rollers 8 of the door leaf member 4 in case the door is designed to b manually operable. For in this case, the rollers 8 of the uppermost section are suppored on the approximately vertically extending wall portion 29 facing the room to be closed, so that the door leaf member 4 cannot be transferred from the outside into the interior of the room and/or into the region of the linearly extending longitudinal section 15 of the intermediate guide member 12. A proper and controlled opening of the door leaf accordingly requires that the door leaf, at the beginning of the opening movement, is slightly lifted. If, instead of manual operation, an approximately horizontally guided motor drive mechanism 44 is provided for the door leaf, then the rollers 8 of the door leaf member 4 must be able to follow this horizontal drive movement direction. This means that the rollers 8 of the door leaf member 4 can pass, under horizontal tensile stress, into the linearly extending longitudinal section 15 of the intermediate guide member 12. The step-down gearing of the motor drive mechanism 44 for the door ensures in this case that a compressive stress from the outside of the door leaf and/or the door leaf member 4 cannot lead to an opening movement thereof.

In order to be able to selectively set for a manual operation and a motor-driven operation of the door leaf, the rollers 8 are adjustable in the upper lateral zones of the door leaf member 4 uppermost in the closed position, in such a way that they are in contact, during manual operation, within the vertical section 29 of the end zone 13 of the intermediate guide members 12, whereas, they are held, in case of motor-driven operation, at a higher level in the closed position in such a way that an approximately horizontal tensile force exerted by the motor drive mechanism 44 allows the rollers 8 to pass into the linear longitudinal section 15 of the intermediate guide member 12. The rollers 8 are arranged, for this purpose, to be arbitrarily adjustable in a vertical plane, which is done, in particular, by a cross-slide guide 45 between the axle mounting of the rollers 8 and their base member connected to the door leaf member 4 (FIG. 1). In this way, it is not only possible to fulfill the respective necessity for manual operation or motor operation, but likewise possible to effect adjustment for the exact setting of the door leaf member 4 with respect to the door leaf plane in the closed position.

The configuration of the intermediate guide member, designed to be linear over a large portion between the end zones, not only affords the advantage of a lower weight balancing shaft arrangement, but is also of special advantage for the case that this intermediate guide member, in a preferred embodiment of the invention, is made as a casting, especially a die-cast zinc element. As can be seen from lines X and Y in FIG. 3, cores which are linearly divided can be utilized during the course of the manufacture which can be removed without any problems after the casting production. Only in the zone of the transition between the linearly extending longitudinal section 15 and the end part 13, bent to a relatively abrupt degree on the frame side, as compared therewith, there are formed sharp-edged transitions on the inside guide surfaces of this intermediate member, requiring a rounding refinishing treatment.

I claim:

1. Sectional overhead door arrangement for low lintel heights, the sectional overhead door arrangement being adapted to be mounted in an opening selectively opened and closed by the sectional overhead door arrangement, the sectional overhead door arrangement comprising:

a frame means for enabling an attachment of the sectional overhead door arrangement to a support structure, the frame means including vertically extending frame elements disposed on respective lateral sides of the opening with each frame element having spaced longitudinally extending rim portions;

a sectional door including a plurality of door leaf members articulated in succession in a vertical direction when the sectional door is in a closed position with one of the door leaf members forming an uppermost door leaf member and one of the remaining door leaf members forming a lowermost door leaf member;

first roller means disposed on respective lateral sides of each of the door leaf members other than the uppermost door leaf member for guiding a movement of the door leaf members, said first roller means being located in an upper area of the respective door leaf members;

primary guide rail means disposed on respective lateral sides of the opening for guiding a movement of the first roller means, each of said primary guide rail means including an approximately vertical guide section respectively secured to the vertically extending frame elements, an approximately horizontal guide section extending from the opening in a direction of an area to be closed by the overhead sectional door arrangement, and arcuate transitional guide sections provided at mutually facing ends of the approximately vertical and horizontal guide sections of said primary guide rail means for joining the respective approximately vertical and horizontal guide sections;

second roller means mounted on respective lateral sides of the uppermost door leaf member for guiding a movement of the uppermost door leaf member, said second roller means being located in an upper area of the uppermost door leaf member;

secondary guide rail means for guiding a movement of the second roller means, each of said secondary guide rail means including a substantially horizontal section disposed above and in parallel to the respective approximately horizontal guide sections of the primary guide rail means, and an intermediate guide member arranged so that the intermediate guide members are lowerable from the horizontal position in such a manner that the uppermost door leaf member, when the uppermost door leaf member is placed in the closed position, is transferred into a plane of the closed overhead sectional door arrangement along a shorter path than the remaining door leaf members;

a weight balancing shaft means having torsion spring means mounted thereon along with rope drum means and shaft bearing means arranged at respective ends of the balancing shaft means;

rope means retained on the respective rope drum means and respectively connected to a lower lateral zone of the door leaf member lowermost in the closed position of the overhead sectional door arrangement;

bearing bracket means affixed in an upper zone of each of the vertically extending frame elements of the frame means, said bearing bracket means including means for guiding accommodating a web member of an associated shaft bearing means; and a threaded bolt means provided on each of the bearing bracket means for pivotally mounting the intermediate guide members of the secondary guide rail means to the bearing bracket means;

wherein each of said intermediate guide members of the secondary guide rail means includes a first angularly disposed end zone and a second curved end zone, and a linearly extending longitudinal section interposed between said first and second end zones of said intermediate guide members, said first angularly disposed end zone of the respective intermediate guide members being connected by said threaded bolt means to the respective bearing bracket means, said second curved end zone of the respective intermediate guide members being connected to the respective approximatley horizontal guide sections of the secondary guide rail means and to the approximately horizontal guide sections of the primary guide rail means, whereby the first roller means are guided along said approximately horizontal guide sections of the primary guide rail means and the second roller means are guided along the approximately horizontal guide sections of the secondary guide rail means during an opening and closing of the sectional overhead door.

2. Sectional overhead door arrangement according to claim 1, wherein the linearly extending longitudinal section forms a large portion of a total length of the intermediate guide member.

3. Sectional overhead door arrangement according to one of claims 1 or 2, wherein the longitudinal section of the intermediate guide member forms a first obtuse angel with the first angularly disposed end zone of the intermediate guide member, and forms a second obtuse angle larger than said first obtuse angle with the second end zone of the intermediate guide member, and forms a second obtuse angle larger than said first obtuse angle with the second end zone of the respective intermediate guide members.

4. Sectional overhead door arrangement according to claim 2, wherein, as viewed from an end face of the second curved end zone of the respective intermediate guide members, a contact surface transition is provided between the linearly extending longitudinal section and the first angularly disposed end zone of the respective intermediate guide membrs.

5. Sectional overhead door arrangement according to claim 1, wherein a connecting plate is provided at the second curved end zone of the respective intermediate guide members for enabling the connection of the intermediate guide members to the respective substantially horizontal section of the respective secondary guide rail means.

6. Sectional overhead door arrangement according to claim 1, further comprising guide tab means provided on each of said intermediate guide members for guiding the respective arcuate transition guide sections of the primary guide rail means, said guide tab means being provided along a lower portion of the respective intermediate guide members in an area between the second curved end zone and the linearly extending longitudinal section of the respective intermediate guide members.

7. Sectional overhead door arrangement according to claim 1, wherein guide tab means laterally bent in a direction toward the frame means out fo a tilting direction about an axis of a bore means for accommodating the threaded bolt means provided on respective intermediate guide members adjoining the angularly disposed end zone of the intermediate guide member, said guide tab means having an opening which, in an assembled condition, aligns with an opening provided in the bearing bracket, said opening in said guide tab means being adapted to accommodate a further threaded bolt means.

8. Sectional overhead door arrangement according to claim 1, wherein said means for accommodating the web member of an associated shaft bearing means includes a first mounting means located at a top of the bearing bracket means disposed in closer proximity to the frame means than mounting means located below the first mounting means.

9. Sectional overhead door arrangement according to claim 1, wherein the shaft bearing means includes a mounting cone for at least one of an adjoining end of the torsion spring means and a ball bearing for the weight balancing shaft means.

10. Sectional overhead door arrangement according to claim 9, wherein at least one of the intermediate guide members and the shaft bearing means and web member are fashioned as a die-cast zinc part.

11. Sectional overhead door arrangement according to claim 1, wherein the second roller means are adjusted in a plane by a cross-slide guide means disposed between an axle mounting of the second roller means and a base member affixed to the uppermost door leaf member.

* * * * *